US008230617B2

(12) United States Patent
Luedecke et al.

(10) Patent No.: US 8,230,617 B2
(45) Date of Patent: Jul. 31, 2012

(54) ARTICLE OF FOOTWEAR FOR WATER SPORTS

(75) Inventors: Tom Luedecke, Portland, OR (US); Sean M. McDowell, Portland, OR (US); Julia Roether, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 863 days.

(21) Appl. No.: 11/862,874

(22) Filed: Sep. 27, 2007

(65) Prior Publication Data

US 2009/0083998 A1 Apr. 2, 2009

(51) Int. Cl.
*A43B 5/08* (2006.01)
*A43C 11/00* (2006.01)

(52) U.S. Cl. ..... 36/8.1

(58) Field of Classification Search ..... 36/110, 36/50.1, 9 R, 77 R, 72 R, 7.3, 7.4, 10, 71, 36/54, 113, 88, 8.1, 4
See application file for complete search history.

(56) References Cited

U.S. PATENT DOCUMENTS

| | | | | |
|---|---|---|---|---|
| 1,637,027 | A | 7/1927 | Piper | |
| 1,717,127 | A | 6/1929 | Toole | |
| 1,952,294 | A | 3/1934 | Strauss | |
| D117,585 | S | 11/1939 | Sperry | |
| 2,933,831 | A | 4/1960 | Le Compte | |
| 3,667,140 | A | 6/1972 | Hunderford | |
| 3,693,270 | A | 9/1972 | Murray | |
| 3,854,228 | A * | 12/1974 | Conroy | 36/71 |
| 4,231,170 | A * | 11/1980 | Griswold | 36/72 R |
| 4,377,913 | A | 3/1983 | Stone | |
| 4,393,605 | A | 7/1983 | Spreng | |
| 4,397,105 | A * | 8/1983 | Richardson | 36/106 |
| 4,428,101 | A | 1/1984 | Harkavy | |
| 4,458,431 | A | 7/1984 | Sinclair | |
| 4,476,639 | A | 10/1984 | Zaccaria | |
| 4,547,981 | A | 10/1985 | Thais et al. | |
| 4,547,982 | A | 10/1985 | Gamm | |
| 4,567,678 | A | 2/1986 | Morgan et al. | |
| 4,624,015 | A * | 11/1986 | Bottoms | 2/22 |
| 4,649,656 | A * | 3/1987 | Cox et al. | 36/4 |
| 4,707,874 | A | 11/1987 | Champagne | |
| RE32,585 | E | 2/1988 | Antonious | |
| 4,756,026 | A * | 7/1988 | Pierce, Jr. | 2/16 |
| 4,793,075 | A * | 12/1988 | Thatcher | 36/11.5 |
| 5,076,288 | A | 12/1991 | Millard et al. | |
| 5,176,624 | A | 1/1993 | Kuehnreich | |
| 5,205,071 | A | 4/1993 | Hergenroeder | |
| 5,211,672 | A * | 5/1993 | Andujar | 36/106 |

(Continued)

FOREIGN PATENT DOCUMENTS

| | | |
|---|---|---|
| FR | 2555026 | 5/1985 |

(Continued)

OTHER PUBLICATIONS

Office Action mailed Jul. 12, 2010 in U.S. Appl. No. 11/862,863.

(Continued)

*Primary Examiner* — Jila M Mohandesi
(74) *Attorney, Agent, or Firm* — Plumsea Law Group, LLC

(57) ABSTRACT

An article of footwear for water sports disclosed. The article includes straps that fasten an upper into place. The straps are configured to maintain a fastened position when water is splashed from below the article. The article further includes padded members to protect the instep and the front ankle of the foot.

20 Claims, 15 Drawing Sheets

U.S. PATENT DOCUMENTS

| | | | | |
|---|---|---|---|---|
| 5,245,767 | A | 9/1993 | Morin | |
| 5,634,245 | A | 6/1997 | Rouser et al. | |
| 5,699,629 | A | 12/1997 | Munschy | |
| 5,701,688 | A | 12/1997 | Crowley | |
| 5,711,092 | A * | 1/1998 | Despres et al. | 36/72 R |
| 5,778,565 | A | 7/1998 | Holt et al. | |
| 5,878,512 | A | 3/1999 | Cooper et al. | |
| 5,913,592 | A | 6/1999 | Moore | |
| D412,780 | S | 8/1999 | Hatfield et al. | |
| D414,317 | S | 9/1999 | Lubart | |
| 5,950,333 | A | 9/1999 | Tsen | |
| D415,610 | S | 10/1999 | Cahill | |
| D417,943 | S | 12/1999 | Solaroli | |
| 6,170,174 | B1 * | 1/2001 | Gesso | 36/72 R |
| 6,183,377 | B1 | 2/2001 | Liang | |
| 6,389,715 | B1 * | 5/2002 | Krajcir | 36/77 R |
| 6,412,114 | B1 * | 7/2002 | Carlin | 2/22 |
| 6,427,363 | B1 | 8/2002 | Hunter | |
| 6,442,875 | B1 | 9/2002 | Joubert et al. | |
| D473,042 | S | 4/2003 | Wilson | |
| D476,141 | S | 6/2003 | Matis | |
| D508,767 | S | 8/2005 | Hatfield | |
| 6,932,784 | B1 * | 8/2005 | Reading | 602/61 |
| D511,614 | S | 11/2005 | Gerber | |
| 6,971,192 | B2 | 12/2005 | Shepherd | |
| 7,028,419 | B2 | 4/2006 | Brooks | |
| 7,069,670 | B1 | 7/2006 | Gerke | |
| 7,082,703 | B2 | 8/2006 | Greene et al. | |
| D533,340 | S | 12/2006 | Chung | |
| 7,316,082 | B2 * | 1/2008 | Hernandez Martinez-Portillo et al. | 36/72 R |
| 7,441,351 | B2 * | 10/2008 | Clark et al. | 36/138 |
| 7,475,501 | B1 * | 1/2009 | DeToro et al. | 36/110 |
| 2004/0175064 | A1 | 9/2004 | Damour | |
| 2005/0178027 | A1 | 8/2005 | Martinez-Portillo et al. | |
| 2006/0137224 | A1 * | 6/2006 | Song | 36/72 R |
| 2006/0143944 | A1 | 7/2006 | Collins | |
| 2008/0098626 | A1 | 5/2008 | Wright | |

FOREIGN PATENT DOCUMENTS

| | | |
|---|---|---|
| FR | 2772564 | 6/1999 |
| FR | 2824451 | 11/2002 |
| WO | WO 2006/050565 | 5/2006 |

OTHER PUBLICATIONS

Office Action mailed Jul. 8, 2010 in U.S. Appl. No. 11/862,885.

* cited by examiner

ARTICLE OF FOOTWEAR FOR WATER SPORTS

BACKGROUND OF THE INVENTION

1. Field of the Invention

The present invention relates generally to footwear and in particular to an article of footwear configured to be worn in water sports.

2. Description of Related Art

Articles of footwear for water sports have been previously proposed. Moore (U.S. Pat. No. 5,913,592) teaches a performance water boot. The Moore design includes a water boot having an adjustable strap that crosses an upper between the instep region and the collar region of the boot. Moore teaches a heel cup that is designed to cooperate with the adjustable strap in order to seal off the heel and ankle regions of the upper. Moore teaches this arrangement to prevent water from entering the instep region and causing the foot to move within the boot.

Collins (U.S. patent number 2006/0143944) teaches an article of footwear designed for surfing. The Collins design includes a thin rubber outsole that wraps underneath the forefoot. Collins further teaches a tread disposed on the bottom of the outsole. However, the Collins design does not include a heel portion, but instead the heel and the rear of the article of footwear is left open to expose the rear and heel of a foot. The Collins design lacks support for the rear of the foot and the heel. Additionally, while Collins teaches a strap for fastening the article of footwear, it is a single strap wrapping around the ankle and in particular no straps are provided for fastening the forefoot.

Hergenroeder (U.S. Pat. No. 5,205,071) teaches a surfing sandal. The sandal includes an instep strap configured to extend across the instep at the top of the foot. According to Hergenroeder, the instep strap may function as an instep pad. Hergenroeder further teaches a traction surface with traction pads adapted to extend across the bottom of the foot between the heel and the ball of the foot. Hergenroeder teaches materials for the sandal including neoprene and materials for the traction pads including rubber.

SUMMARY OF THE INVENTION

An article of footwear configured for water sports is disclosed. In one aspect, the invention provides an article of footwear configured to provide traction on a wet surface, comprising: a water durable upper and a slip-resistant sole; a fastening region disposed adjacent to a periphery of the sole; a first fastening strap including a first free portion configured to fasten to the fastening region, the first fastening strap configured to extend from a medial side to a lateral of the footwear; a second fastening strap including a second fixed portion disposed below the first fastening region and a second free portion configured to fasten to the first portion of the first fastening strap; and where the second free portion of the second fastening strap covers a substantial majority of the first free portion of the first fastening strap.

In another aspect, the upper includes a plurality of padded members associated with an instep portion and a front ankle portion.

In another aspect, the plurality of padded members are spaced apart from one another.

In another aspect, the padded members are attached to an inner surface of the upper.

In another aspect, the padded members are attached to an outer surface of the upper.

In another aspect, the plurality of padded members includes six padded members.

In another aspect, the invention provides an article of footwear configured to provide traction on a wet surface, comprising: a water durable upper and a slip-resistant sole; the upper including an inner surface and an outer surface; a plurality of padding members associated with an instep portion and a front ankle portion of the footwear; the plurality of padding members being spaced from one another; and where the plurality of padding members are attached to the inner surface of the upper.

In another aspect, the upper includes a strap system comprising a first fastening strap and a second fastening strap.

In another aspect, the first fastening strap includes a first free portion that is configured to connect to a fastening region associated with the upper.

In another aspect, the second fastening strap includes a first fixed portion that is attached to the upper just below the fastening region.

In another aspect, the second fastening strap includes a first free portion that is configured to cover the first free portion.

In another aspect, the plurality of padded members comprises six padded members.

In another aspect, the upper is configured to bend at the instep portion and the front ankle portion.

In another aspect, the invention provides an article of footwear configured to provide traction on a wet surface, comprising: a water durable upper and a slip-resistant sole; a padded member disposed on an instep region of the upper, the padded member being configured to protect an instep portion of a foot; the padded member including a first portion and a second portion; and wherein a first slot and a second slot are disposed between the first portion and the second portion.

In another aspect, the padded member comprises multiple portions.

In another aspect, the multiple portions are separated by multiple slots.

In another aspect, the first slot and the second slot are v-shaped.

In another aspect, the padded member comprises three portions.

In another aspect, the padded member includes four slots.

In another aspect, the padded member includes an outer layer and a padding layer.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
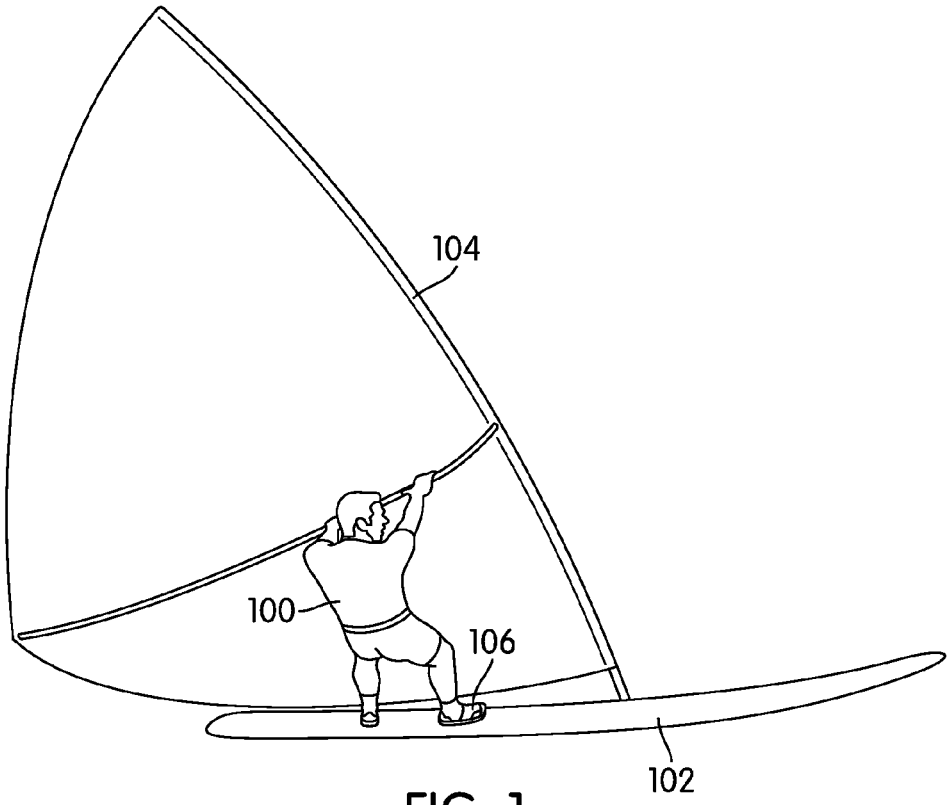
FIG. 1 is a preferred embodiment of an athlete standing on a windsurf board.

FIG. 1 is a preferred embodiment of athlete 100 operating vessel 102. In this embodiment, athlete 100 is standing on vessel 102. The term 'athlete' as used throughout this detailed specification and in the claims refers to anyone capable of operating vessel 102. The term athlete is not meant to be restricted to pro athletes, amateur athletes or any other type of competitors. In some embodiments, athlete 100 may not be competing in any sport or activity. In this preferred embodiment, athlete 100 is a windsurfer.

In this embodiment, vessel 102 is a windsurf board or sailboard. However, in other embodiments, vessel 102 could be a kiteboard, wakeboard or similar type of board. In this embodiment, vessel 102 includes sail 104. In other embodiments, vessel 102 may not include sail 104. For example, in some embodiments, athlete 100 may ride a wakeboard that is pulled behind a motor boat.

In a preferred embodiment, athlete 100 is wearing pair of footwear 106 configured to facilitate athlete 100 in performing various activities associated with windsurfing. Preferably, footwear 106 may be adapted for water related activities. Some embodiments of footwear 106 include provisions that allow footwear 106 to function successfully in wet or nautical environments. These provisions can include features such as slip-resistant provisions, quick fastening provisions, insulating provisions as well as provisions for increased support. Such provisions are useful because athlete 100 may often be stepping in water, as well as stepping on wet and slippery surfaces. These various provisions will be discussed in the remainder of this detailed description.

Figure 2:
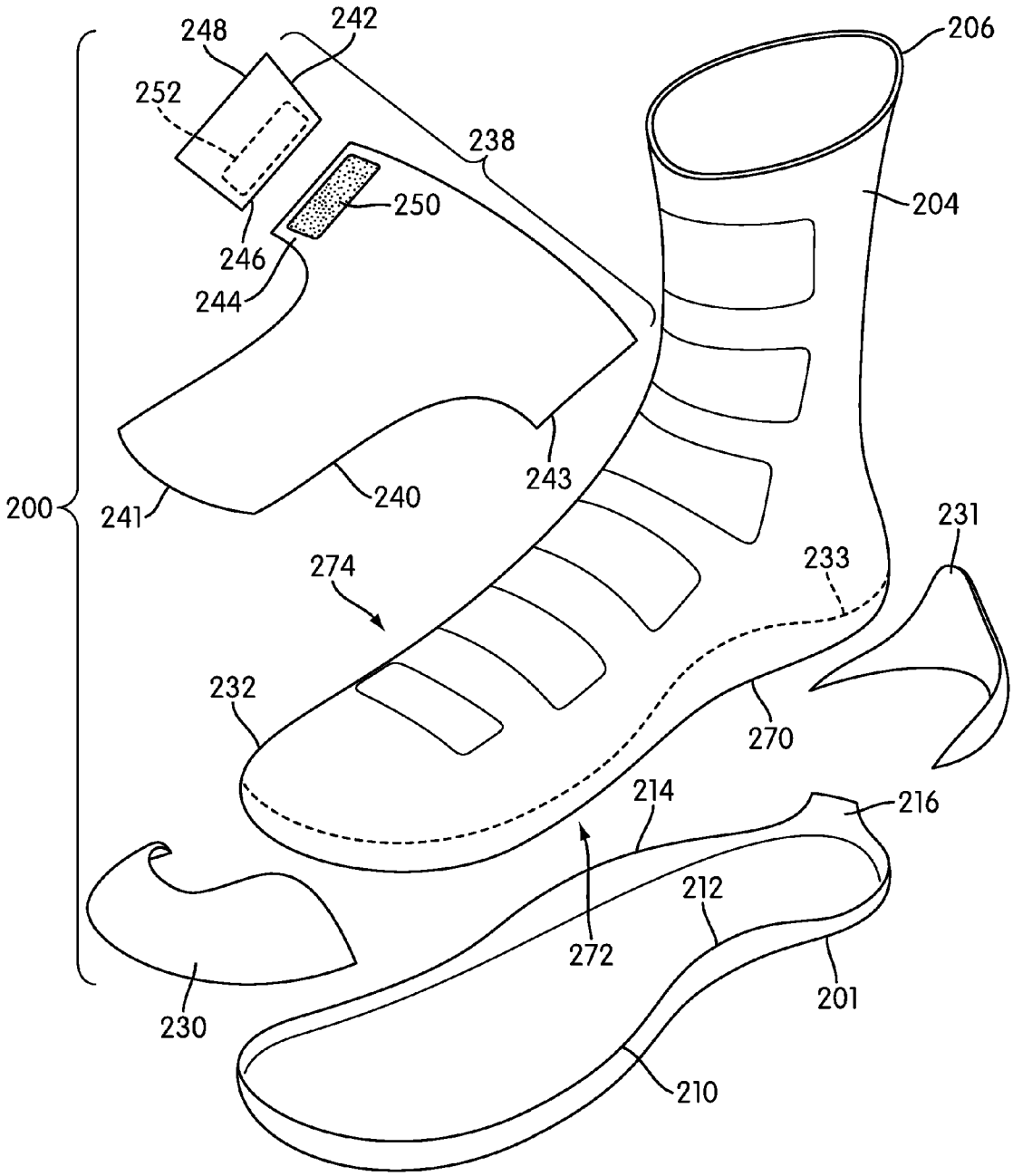
FIG. 2 is an exploded isometric view of a preferred embodiment of an article of footwear.

FIG. 2 is an exploded isometric view of a preferred embodiment of article of footwear 200. In this preferred embodiment, article of footwear 200 is a windsurfing shoe. In other embodiments, article of footwear 200 could be a wakeboarding shoe, a kiteboarding shoe or another kind of water shoe. In particular, the features of article of footwear 200 that are useful for windsurfing may be equally applicable and useful in similar water sports such as those previously discussed here. Although a single article of footwear is discussed in this preferred embodiment, it should be understood that similar provisions and features may apply to a complementary article of footwear as well, which is generally made in the mirror image of article of footwear 200.

Article of footwear 200 includes upper 204. In some embodiments, upper 204 may be made of a soft and flexible material. Examples of such materials include elastic materials and any type of water proof materials. In a preferred embodiment, upper 204 is made of neoprene or a similar material. Using this preferred material, upper 204 may be configured to provide insulation for a foot during use. More generally, upper 204 may be made of a water durable material. The term 'water durable' is used throughout this detailed specification and in the claims to refer to any material that is not affected by extended exposure to water. This is important because article of footwear 200 may get wet many times during windsurfing or similar water activities.

By using a flexible material, upper 204 may conform to a foot in order to prevent excessive water from seeping through ankle collar 206. In some embodiments, ankle collar 206 may include an additional elastic lining configured to close tightly around the foot of athlete 100. Although water may be absorbed through upper 204 during use, excessive water may be prevented from building up because of the conforming nature of upper 204, which may help prevent slipping or chaffing of upper 204 due to excess water building up within upper 204.

In some embodiments, article of footwear 200 includes sole 201. In this embodiment, sole 201 may be a wrap-around sole. The term 'wrap-around sole' is used throughout the remainder of this detailed description and in the claims to refer to any sole including a periphery that extends vertically around the sides of upper 204. In this embodiment, sole 201 includes side wall periphery 210.

Additionally, in some embodiments, side wall periphery 210 may further include medial extended portion 212, lateral extended portion 214 and heel extended portion 216. Generally, portions 212, 214 and 216 may be constructed as flaps that extend further beyond side wall periphery 210. In some embodiments, portions 212, 214 and 216 may be attached directly to upper 204. In other embodiments, portions 212, 214 and 216 may not attach directly to upper 204, but may flap instead with respect to sole 201.

In addition to sole 201 and upper 204, article of footwear 200 preferably includes toe member 230. In some embodiments, toe member 230 may be configured to attach directly to sole 201. In other embodiments, toe member 230 may be configured to attach to upper 204. In a preferred embodiment, toe member 230 may be configured to attach to both upper 204 and sole 201, simultaneously. Generally, toe member 230 may be made of any durable material including various kinds of rubber. This arrangement preferably provides additional protection to toe region 232 of article of footwear 200.

Upper 204 may be further associated with heel member 231. In some embodiments, heel member 231 may be configured to attach directly to sole 201. In other embodiments, heel member 231 may be configured to attach to upper 204. In a preferred embodiment, heel member 231 may be configured to attach to both upper 204 and sole 201, simultaneously. Generally, heel member 231 may be made of any durable material including various kinds of rubber. In some cases, heel member 231 may act as a heel counter. This arrangement preferably provides additional protection to heel region 233 of article of footwear 200.

Often, a windsurf board may include straps or fasteners configured to attach to an article of footwear. This may be done in order to partially fasten athlete 100 to the windsurf board. Preferably, in these cases, toe member 230 and heel member 231 help protect the foot from rigid fasteners or straps that may rub against the foot and cause bruising.

Preferably, article of footwear 200 includes provisions for fastening upper 204 and sole 201 to a foot. In some embodiments, article of footwear 200 includes some kind of fastening straps. In a preferred embodiment, article of footwear 200 may include straps configured to tighten a forefoot portion of upper 204.

In this preferred embodiment, article of footwear 200 includes strap system 238. In some embodiments, strap system 238 may include first fastening strap 240 and second fastening strap 242. First fastening strap 240 preferably includes front portion 241, first fixed portion 243 and first free portion 244. Likewise, second fastening strap 242 preferably includes second fixed portion 248 and second free portion 246. Preferably, first free portion 244 is associated with first fastening region 250 and second free portion 246 is associated with second fastening region 252.

In a preferred embodiment, front portion 241 is configured to be fixedly attached to toe region 232. In some embodiments, front portion 241 of first fastening strap 240 may be stitched to upper 204 at toe region 232. Additionally, in some embodiments, front portion 241 may also be attached to toe member 230 using an adhesive of some kind. Preferably, front portion 241 is disposed beneath toe member 230.

Preferably, first fixed portion 243 is configured to be fixedly attached to upper 204 at periphery 270 on medial side 272. First fixed portion 243 is preferably fixed to upper 204 via stitching. In some embodiments, periphery 270 may be the region of upper 204 that is attached to sole 201. Also, second fixed portion 248 of second fastening strap 242 is fixedly attached to periphery 270 on lateral side 274.

It should be understood that strap system 238 is optional and may not be included in other embodiments. In these cases, article of footwear 200 may be provided with other provisions for securing upper 204 in place. In some cases, upper 204 may be secured in place by tightly conforming to the foot of a wearer rather than using straps or other provisions.

FIGS. 3-11 are intended to further illustrate various provisions associated with the different components discussed in the current embodiment. In particular, provisions associated with upper 204, sole 201 and strap system 238 are discussed in further detail.

Preferably, upper 204 includes provisions for protecting the instep and front ankle of a foot. In this embodiment, upper 204 preferably includes a plurality of padded members. In a preferred embodiment, the plurality of padded members may extend over the instep portion and the front ankle portion of upper 204.

Figure 3:
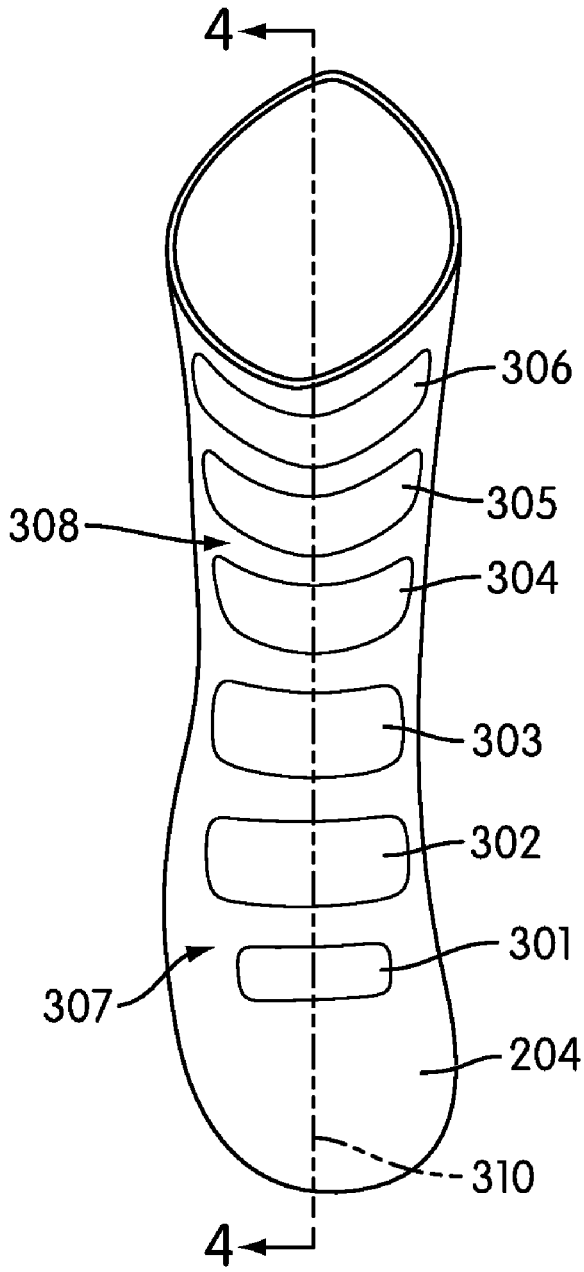
FIG. 3 is a front isometric view of a preferred embodiment of an upper of an article of footwear.

FIG. 3 is a front isometric view of a preferred embodiment of upper 204. In this embodiment, upper 204 includes first padded region 301, second padded region 302 and third padded region 303 disposed on instep portion 307 of upper 204. Additionally, upper 204 may include fourth padded region 304, fifth padded region 305 and sixth padded region 306 disposed on front ankle portion 308 of upper 204. In some embodiments, padded regions 301-306 are symmetric about symmetry line 310 in order to provide protection across the top of upper 204.

Figure 4:
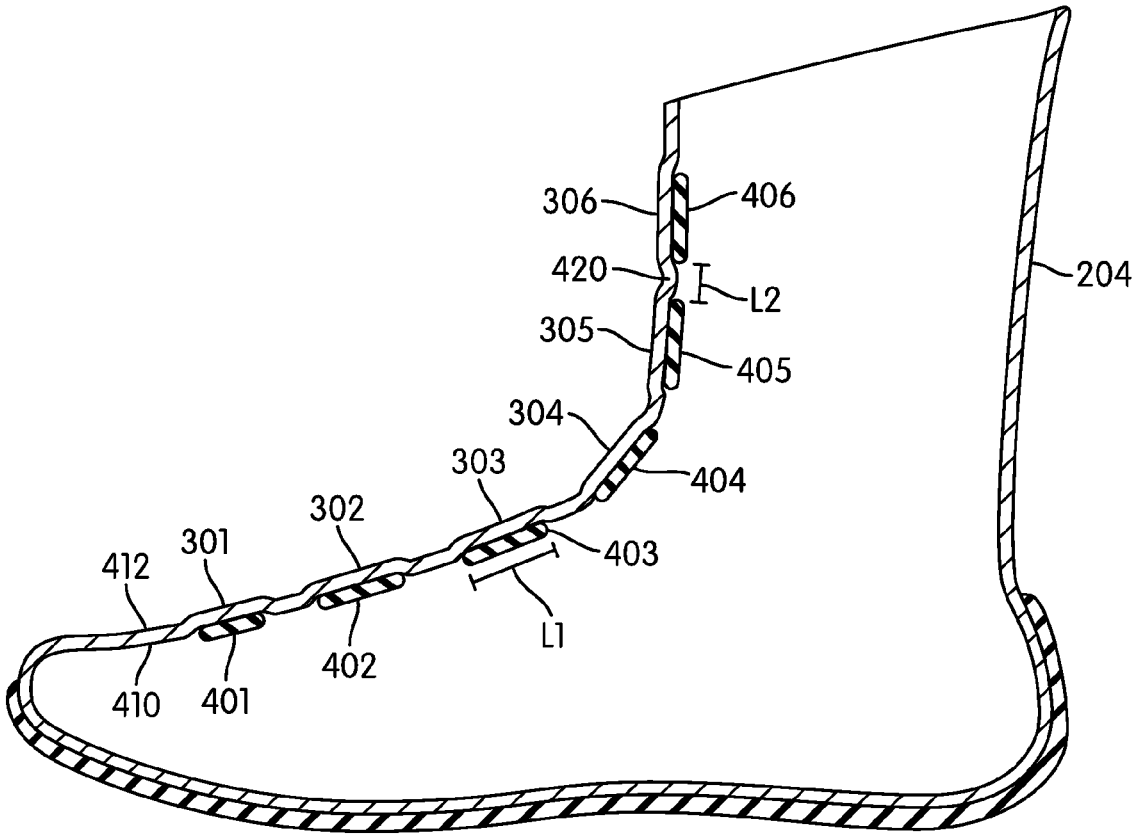
FIG. 4 is a cross sectional view of a preferred embodiment of padded regions of an upper.

FIG. 4 is a cross sectional view of a preferred embodiment of padded regions 301-306. Preferably, padded regions 301-306 are associated with a plurality of padded members disposed within upper 204. In particular, first padded region 301 is associated with first padded member 401, second padded region 302 is associated with second padded member 402, third padded region 303 is associated with third padded member 403, fourth padded region 304 is associated with fourth padded member 404, fifth padded region 305 is associated with fifth padded member 405 and sixth padded region 306 is associated with sixth padded member 406.

Padded members 401-406 are preferably made of a substantially similar material. In some embodiments, padded members 401-406 may be made of soft foam or foam-like padding materials. In a preferred embodiment, padded members 401-406 may be made of a material that is a shock absorbing material and which is not irritating to the skin of athlete 100. In some embodiments, padded members 401-406 may comprise a foam pad with a fabric cover configured to facilitate comfort for athlete 100.

In some embodiments, padded members 401-406 are attached to upper 204. In a preferred embodiment, padded members 401-406 may be attached to inner surface 410 of upper 204. In some embodiments, padded members 401-406 may be stitched to upper 204. In some cases, this stitching may be visible on outer surface 412 of upper 204. In some embodiments, padded members 401-406 may be attached to inner surface 410 using glue or another type of adhesive. In other embodiments, padded members 401-406 may be attached to outer surface 412 of upper 204. In still other embodiments, padded members 401-406 could be disposed between an outer lining and an inner lining of upper 204.

In some embodiments, padded members 401-406 are spaced apart on upper 204. In some embodiments, padded members 401-406 may be separated by intermediate portions 420. Generally, the spacing between padded members 401-406 may vary. In some embodiments, the spacing may be slightly smaller than the length of padded members 401-406. In this embodiment, padded members 401-406 are associated with a length L1 and the length of intermediate portions 420 is equal to length L2. Preferably length L2 is slightly smaller than length L1. In the current embodiment, the lengths of padded members 401-406 are generally equal; however in other embodiments each padding member may be associated with a distinct length. Likewise, the spacing between padded members 401-406 may vary according to the location on upper 204.

Figure 5:
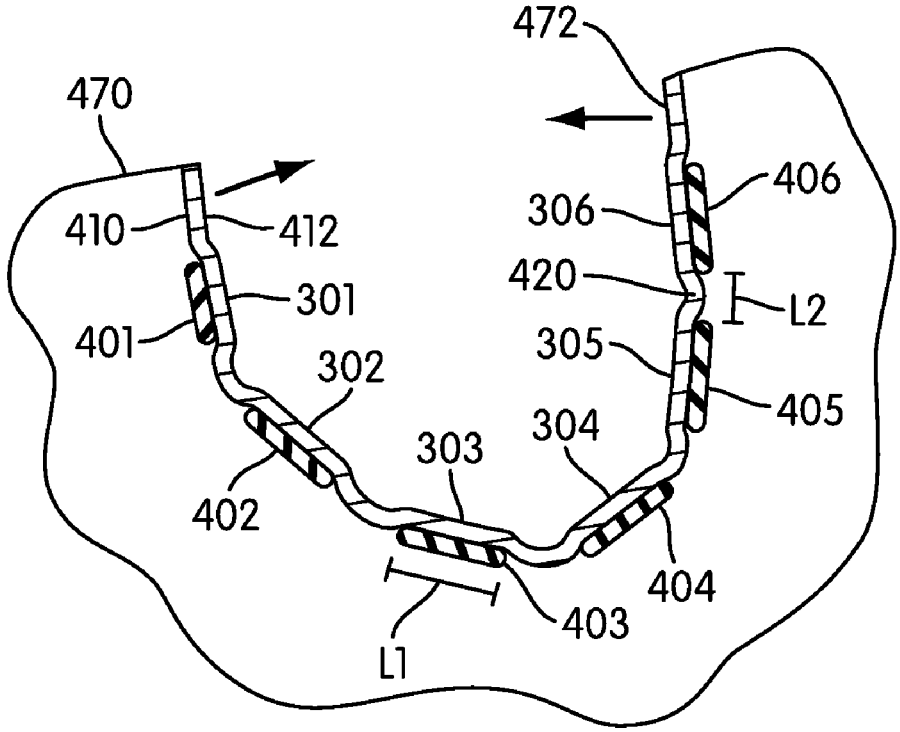
FIG. 5 is a side view of a preferred embodiment of an article of footwear bending.

Using this spaced arrangement for padded members 401-406 may facilitate bending of upper 204, as seen in FIG. 5. In this embodiment, toe portion 470 of upper 204 is bending towards ankle portion 472 of upper 204. Preferably, as toe portion 470 and/or ankle portion 472 experiences bending, upper 204 may fold or bend at intermediate portions 420. In prior designs that incorporate a single pad for the instep and/or ankle portions, this type of bending is restricted by the resistance to bending of the more durable padding material. In this case, however, padded members 401-406 are spaced to allow upper 204 to bend or deform between them. This configuration is useful in many water sports, including windsurfing, as it may be necessary for athlete 100 to bend their foot during operation of vessel 102.

Although upper 204 is seen to bend inwards in this embodiment, it should be understood that this preferred arrangement allows for outward bending as well. Additionally, in other embodiments, the orientation, size and thickness of padded members 401-406 may be modified to allow for different bending properties of upper 204.

Preferably, article of footwear 200 includes slip-resistant provisions. In some embodiments, article of footwear 200 may include a sole configured to provide extra traction in wet conditions. In a preferred embodiment, the sole may include provisions for channeling water away from article of footwear 200 in order to increase traction.

Figure 6:
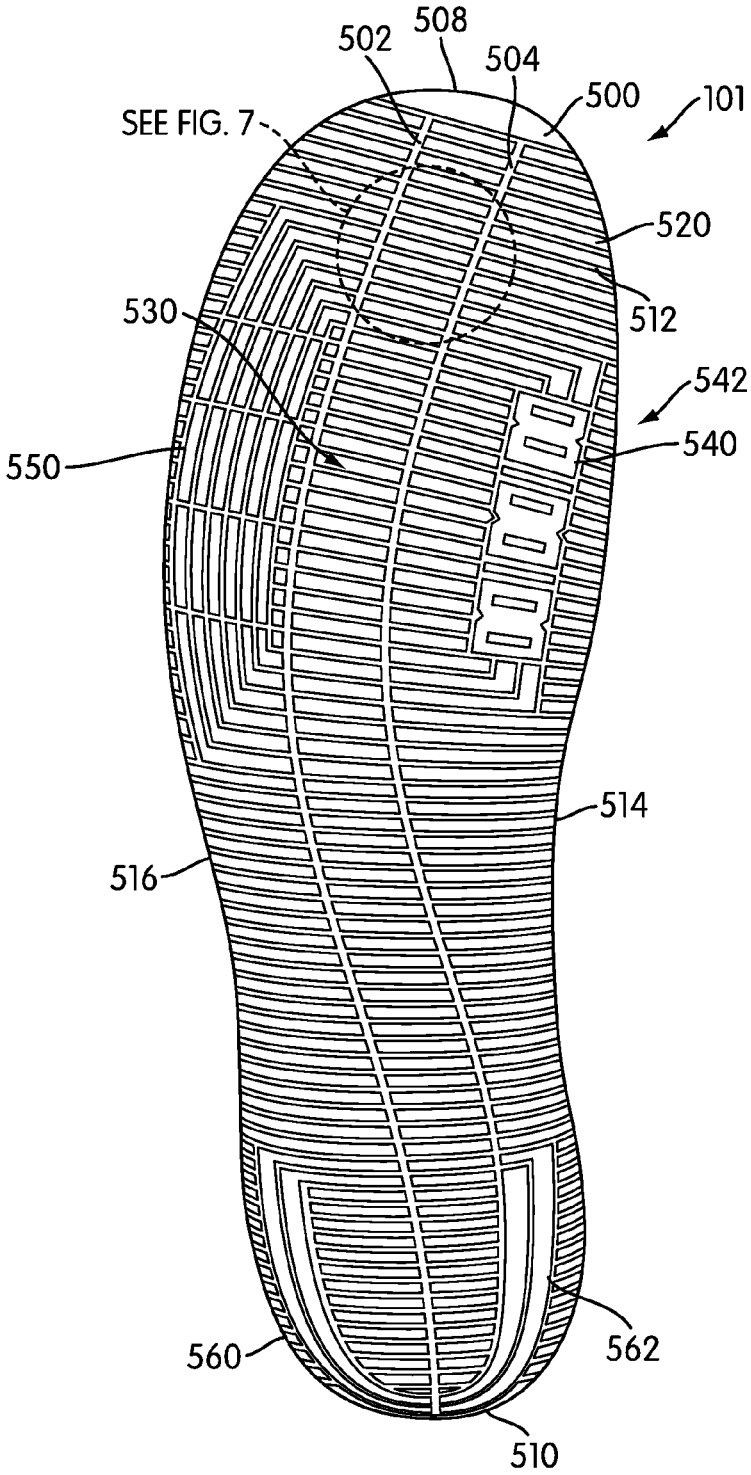
FIG. 6 is a preferred embodiment of a bottom portion of a sole of an article of footwear.

FIG. 6 is a preferred embodiment of bottom portion 500 of sole 201. Preferably, bottom portion 500 includes first central channel 502 and second central channel 504. In some embodiments, first central channel 502 and second central channel 504 may grooves disposed in bottom portion 500. Preferably, channels 502 and 504 extend from forward end 508 to rear end 510 of bottom portion 500.

In some embodiments, bottom portion 500 may also include lateral channels 512. Preferably, lateral channels 512 extend from medial side 514 to lateral side 516 of bottom portion 500. In this preferred embodiment, lateral channels 512 may intersect central channels 502 and 504. In this embodiment, lateral channels 512 are generally perpendicular to central channels 502 and 504, however in other embodiments, lateral channels 512 could be disposed at any angle with respect to central channels 502 and 504.

Figure 7:
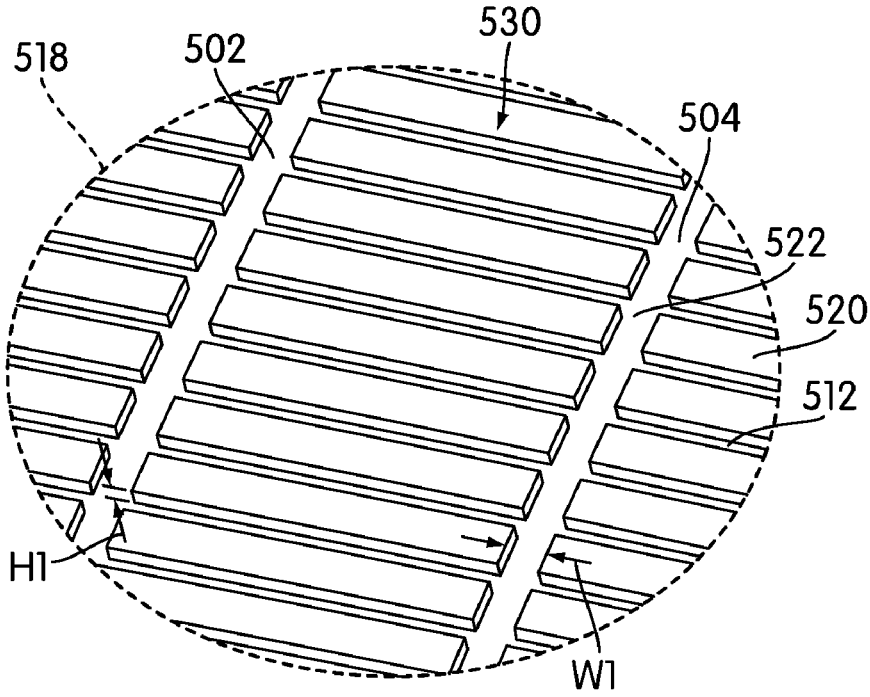
FIG. 7 is a close up view of a preferred embodiment of a portion of a bottom portion of a sole of an article of footwear.

Referring to FIG. 7, a close up of a preferred embodiment of first portion 518 of bottom portion 500, channels 502, 504 and 512 form grooves in sole 201. In some embodiments, tread elements 520 may be disposed between channels 502, 504 and 512. In a preferred embodiment, tread elements 520 extend a height H1 above base surface 522 of bottom portion 500. In some embodiments, height H1 may range from 0.1 millimeters to 5 millimeters. In a preferred embodiment, height H1 has a value of 1 millimeter.

Generally, the widths of channels 502, 504 and 512 may vary. In this embodiment, second central channel 504 has a width W1. Preferably, the widths of channels 502 and 512 are substantially similar to width W1 of second central channel 504. The value of width W1 may vary between 0.1 millimeters and 2 millimeters. In a preferred embodiment, width W1 has a value of 1 millimeter.

Referring to FIGS. 6-7, central channels 502 and 504 define a central contact region 530. In particular, central contact region 530 includes the region between central channels 502 and 504. Preferably, central contact region 530 is configured to engage a surface first. If the surface is wet, water is preferably channeled away from central contact region 530 via channels 502, 504 and 512. In a preferred embodiment, water moves longitudinally through central channels 502 and 504 and laterally outwards through lateral channels 512. Using this preferred configuration, as water is generally directed out from under bottom portion 500, tread elements 520 may more easily contact the surface. This arrangement helps prevent slipping due to losses in friction caused by water disposed between tread elements 520 and the surface.

In some embodiments, sole 201 may include additional provisions for increasing traction on wet surfaces. In this preferred embodiment, bottom portion 500 also includes large recesses 540 disposed at ball region 542. Typically, a majority of weight is put on the ball of the foot. Therefore, as a wearer steps down, excess water contacting ball region 542 may be pumped away with greater efficiency though large recesses 540.

In some embodiments, bottom portion 500 may also include additional curved channels. In this preferred embodiment, bottom portion 500 may include curved channels 550. In some cases, curved channels 550 may provide additional traction during pivoting, as bottom portion 500 may rotate about ball region 542. In other embodiments, curved channels 550 may provide additional longitudinal channels for the water to move along, thus increasing the distribution to lateral channels 512.

In some embodiments, bottom portion 500 may also include provisions for increasing traction at heel region 560. To provide increased traction as the heel is lowered, heel region 560 may include U-shaped channels 562. These channels preferably facilitate the pumping of water away from heel region 560, especially at central contact region 530.

It should be understood that large recesses 540, curved channels 550 and U-shaped channels 562 are optional. In other embodiments, only some of these provisions may be incorporated into bottom portion 500. In still other embodiments, none of these additional provisions may be used. Generally, by including some of these additional provisions, the type of traction achieved may be modified. Additionally, varying height H1 associated with tread elements 520 and width W1 associated with channels 502, 504 and 512, the amount of traction may also be varied.

Using these provisions associated with sole 201, article of footwear 200 may be configured to provide increased traction on a wet surface. This feature is especially important for articles of footwear used in various water sports such as windsurfing, wakeboarding and similar sports. As athlete 100 steps on vessel 102, rocks or other wet surfaces, sole 201 may facilitate reduced slipping.

Figure 8:
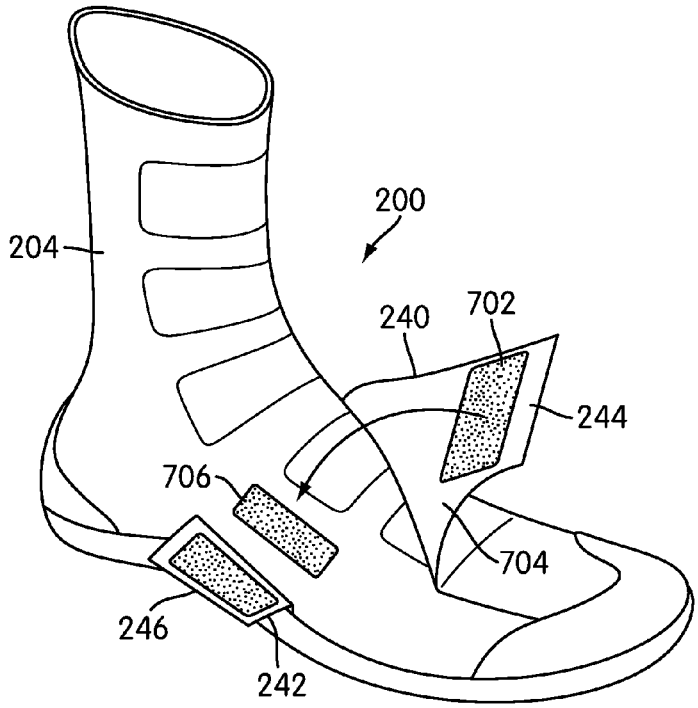
FIG. 8 is an isometric view of a preferred embodiment of a strap system of an article of footwear in an open position.
Figure 9:
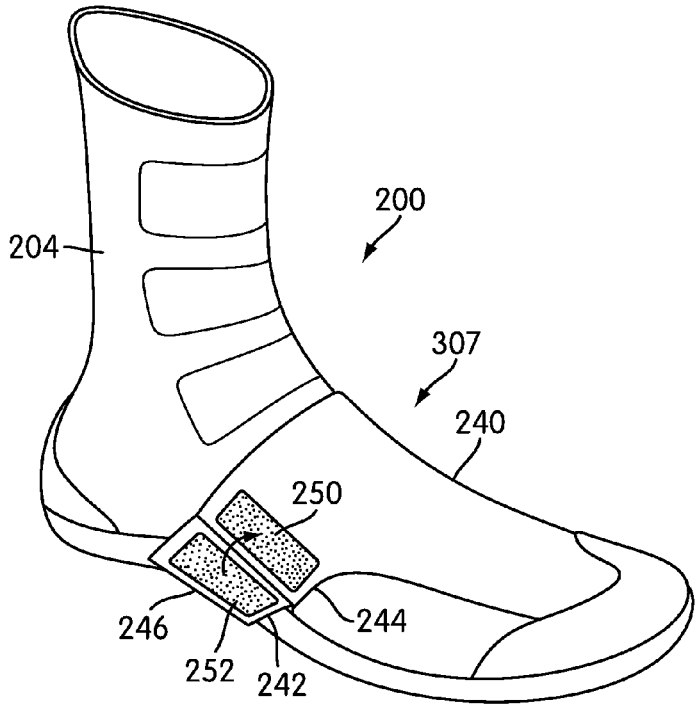
FIG. 9 is an isometric view of a preferred embodiment of a strap system of an article of footwear fastening.
Figure 10:
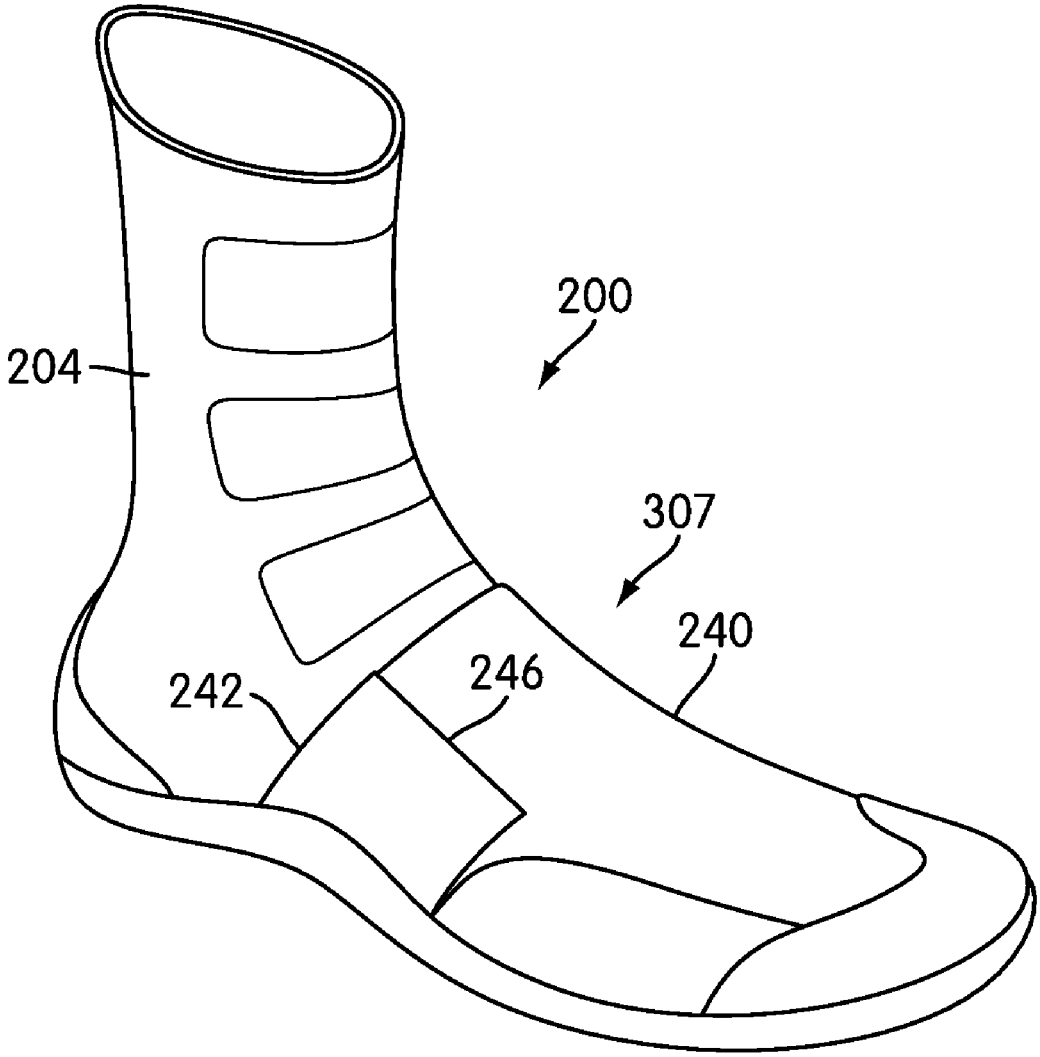
FIG. 10 is an isometric view of a preferred embodiment of a strap system of an article of footwear in a closed position.

Preferably, an article of footwear configured to be used in windsurfing or similar activities includes provisions for securely attaching fastening straps. FIGS. 8-10 are intended to illustrate the fastening of strap system 238 around article of footwear 200. In FIG. 8, first free portion 244 of first fastening strap 240 and second free portion 246 of second fastening strap 242 are in an open position.

Preferably, first free portion 244 includes third fastening region 702 that is disposed on first side 704 of first fastening strap 240. Third fastening region 702 may be configured to fasten to fourth fastening region 706 that is disposed on upper 204. Generally, fastening regions 702 and 706 may be associated with any type of fasteners. In a preferred embodiment, fastening regions 702 and 706 are associated with complementary sides of a hook and loop fastener, such as Velcro®.

Referring to FIGS. 9-10, once first free portion 244 has been fastened in place; second fastening strap 242 may be configured to fasten to first fastening strap 240. Preferably, second fastening region 252 of second free portion 246 may be configured to attach to first fastening region 250 of first free portion 244. Generally, any type of fasteners may be used with fastening regions 250 and 252. In a preferred embodiment, fastening regions 250 and 252 comprise complementary sides of a hook and loop fastener, such as Velcro®.

Using this preferred configuration, strap system 238 may be used to fasten upper 204 at instep portion 307. This configuration is preferable to a traditional lacing system or other fastening system, since strap system 238 can be easily adjusted. This may allow athlete 100 to secure article of footwear 200 into place during activities such as windsurfing where there is little time for pulling laces tight.

Figure 11:
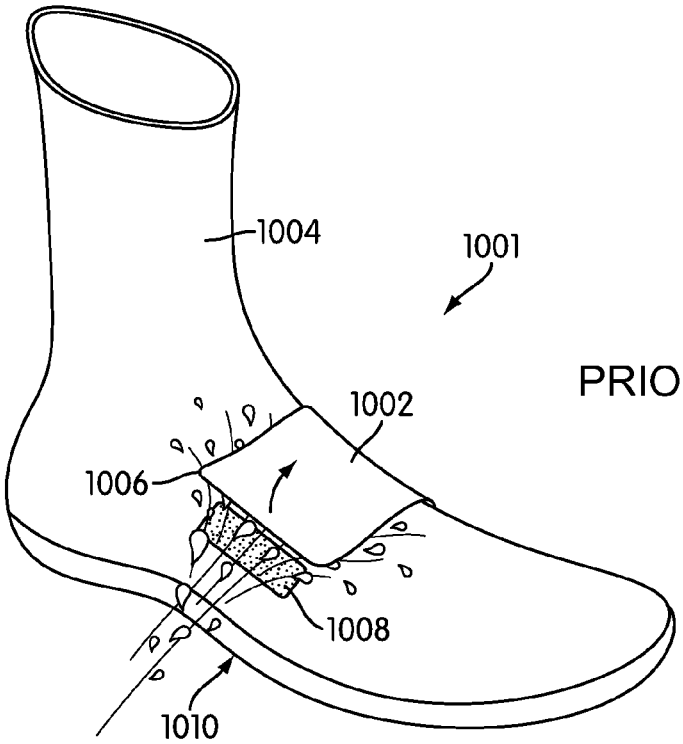
FIG. 11 is an isometric view of an exemplary embodiment of an article of footwear with splashing water.
Figure 12:
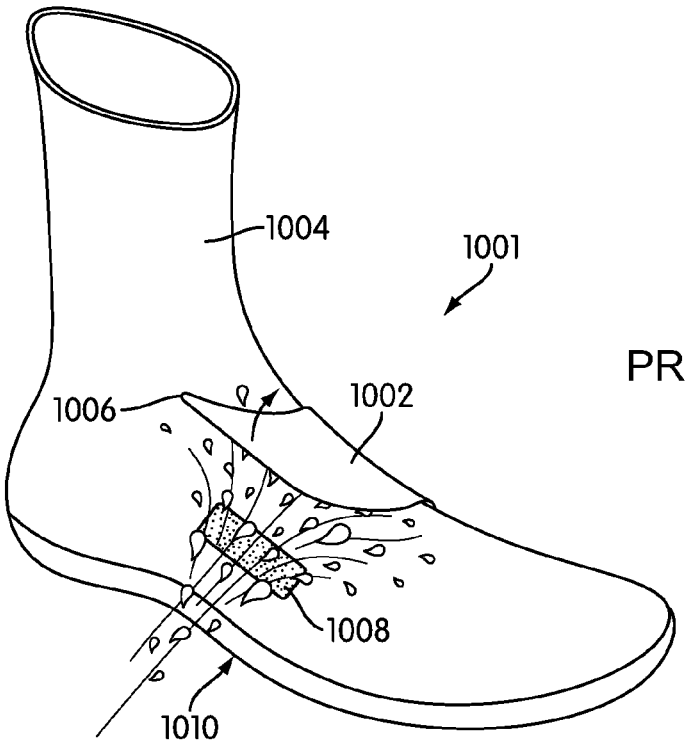
FIG. 12 is an isometric view of an exemplary embodiment of an article of footwear with splashing water.
Figure 13:
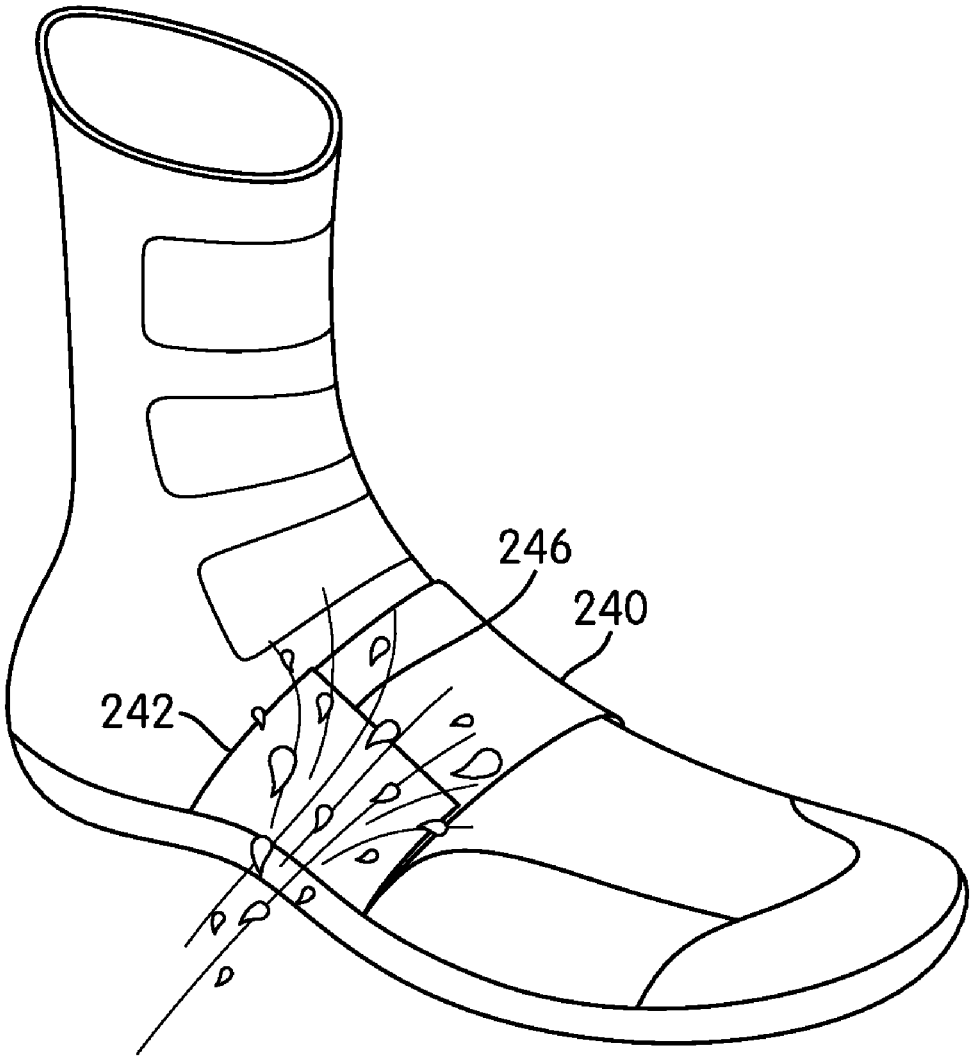
FIG. 13 is an isometric view of a preferred embodiment of an article of footwear with splashing water.

FIGS. 11-13 are intended to illustrate the utility of strap system 238. In a prior design, seen in FIGS. 11-12, single strap 1002 may be used to fasten upper 1004 of article of footwear 1001 around a foot. During windsurfing or similar activities, splashing water may come up from under article of footwear 1001. In some cases, the force of this splashing water could be enough to loosen and eventually undo single strap 1002. This is generally a result of the design of traditional strap systems. In this case, single strap 1002 includes free portion 1006 configured to fasten to fastening region 1008 of lateral side 1010. With this arrangement, free portion 1006 is exposed to water splashing up from below.

Alternatively, using the preferred arrangement discussed in this detailed description, strap system 238 may be configured to remain fastened when water is splashed from below. Referring to FIG. 13, as water splashes up from below, second fastening strap 242 is configured to remain fastened to first fastening strap 240. Because of the orientation of second free portion 246, as water splashes up from below it cannot get underneath second fastening strap 242 to loosen the strap. With this preferred configuration, strap system 238 may remain fastened during activities such as windsurfing, wakeboarding or similar activities that expose an article of footwear to upward splashing water.

In an alternative embodiment, an article of footwear configured for windsurfing could be configured for alternative water sports. In some cases, the article of footwear could be configured for sailing. In a preferred embodiment, the article of footwear may include a pad configured to protect the instep portion of the foot.

Figure 14:
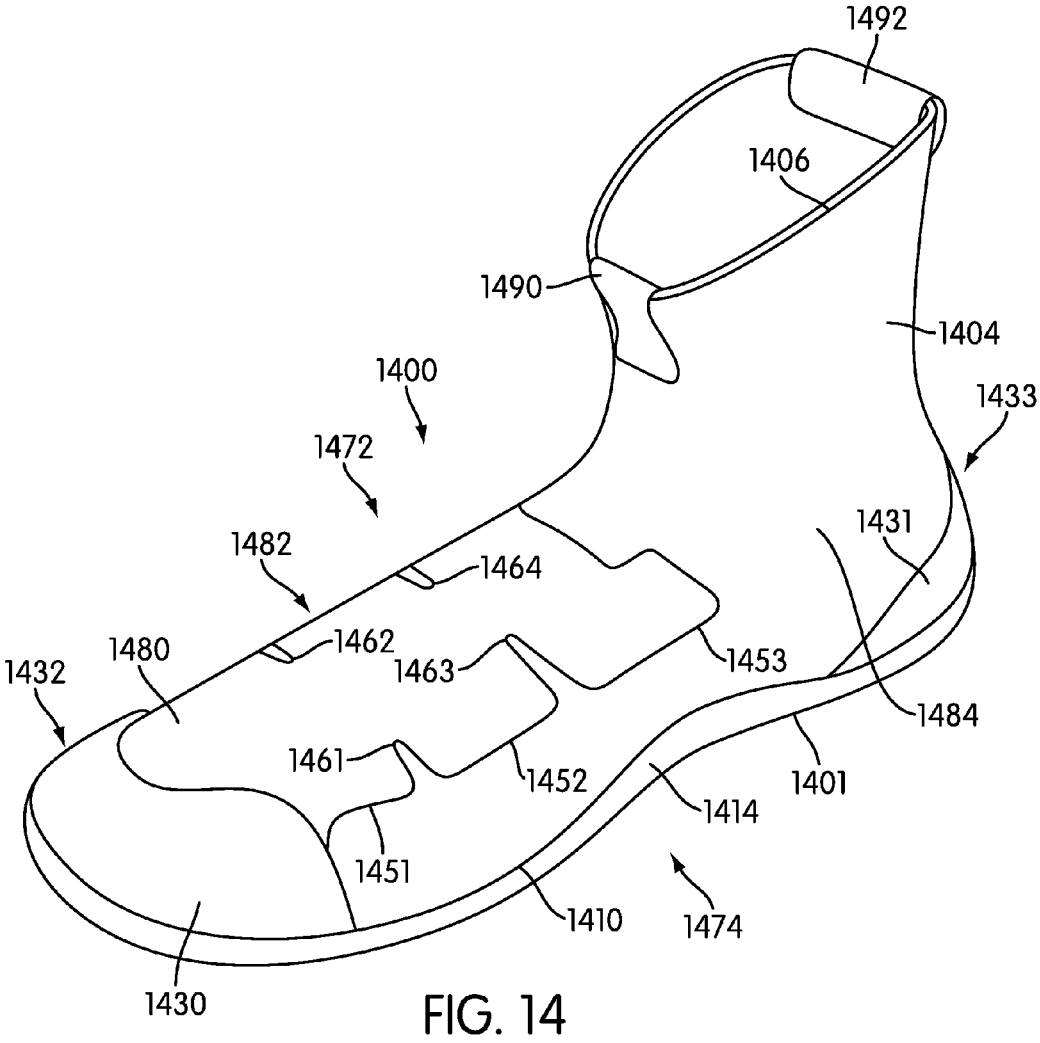
FIG. 14 is an isometric view of a preferred embodiment of an article of footwear.
Figure 15:
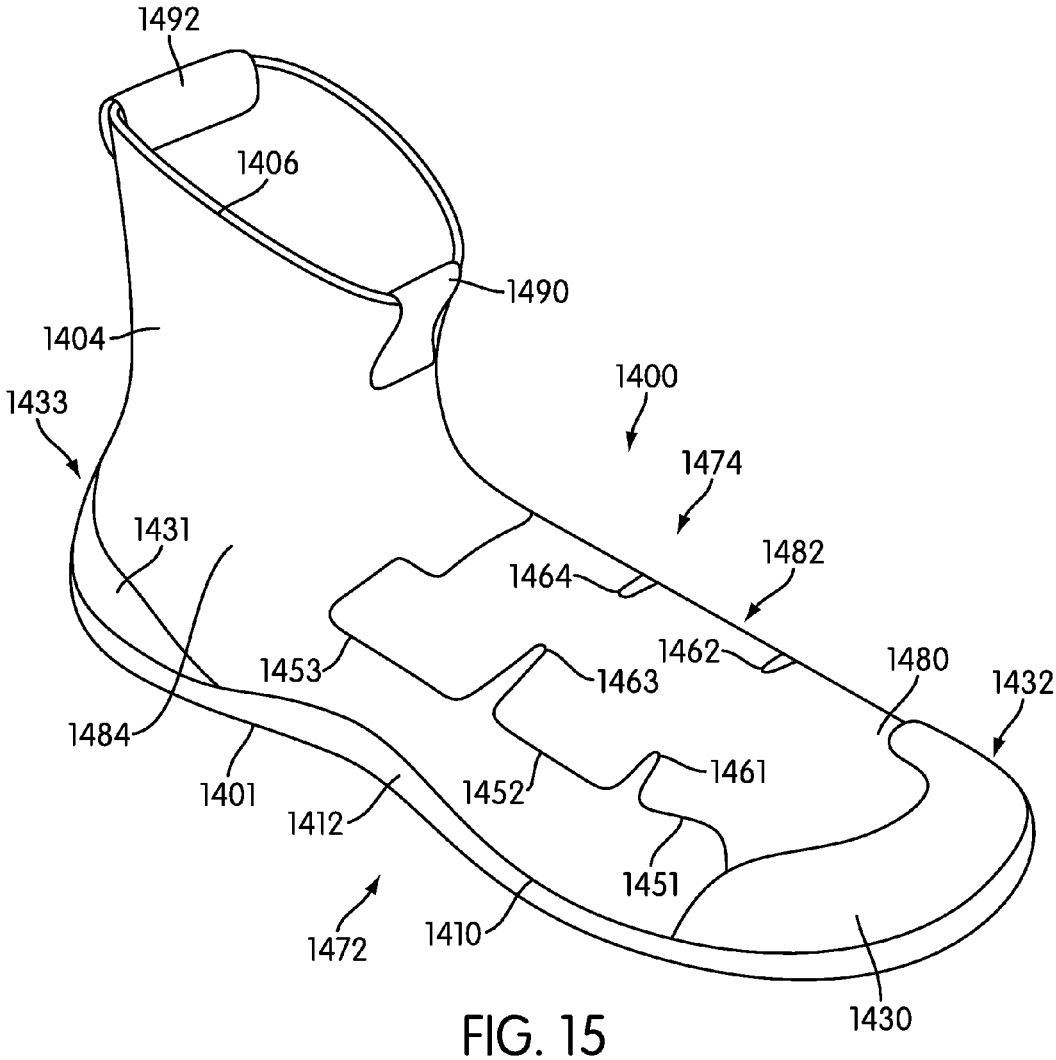
FIG. 15 is an isometric view of a preferred embodiment of an article of footwear.

FIGS. 14-15 illustrate a preferred embodiment of article of footwear 1400. In this preferred embodiment, article of footwear 1400 is a crewman shoe for sailing. In other embodiments, article of footwear 1400 could be configured for other types of water sports. In particular, the features of article of footwear 1400 that are useful for sailing may be equally applicable and useful in similar water sports such as those previously discussed here.

Article of footwear 1400 includes upper 1404. In some embodiments, upper 1404 may be made of a soft and flexible material. Examples of such materials include elastic materials and any type of water proof materials. In a preferred embodiment, upper 1404 is made of neoprene or a similar material. Using this preferred material, upper 1404 may be configured to provide insulation for a foot during use. More generally, upper 1404 may be made of a water durable material. This is important because article of footwear 1400 may get wet many times during sailing or similar water activities.

By using a flexible material, upper 1404 may conform to a foot in order to prevent excessive water from seeping through ankle collar 1406. In some embodiments, ankle collar 1406 may include an additional elastic lining configured to close tightly around the foot of a crewman. Although water may be absorbed through upper 1404 during use, excessive water may be prevented from building up because of the conforming nature of upper 1404, which may help prevent slipping or chaffing of upper 1404 due to excess water building up within upper 1404.

In some cases, upper 1404 may include provisions that help a crewman put on article of footwear 1400. In this embodiment, upper 1404 preferably includes first collar tab 1490 and second collar tab 1492. This preferred configuration allows a wearer to grasp collar tabs 1490 and 1492 to pull ankle collar 1406 open to facilitate slipping in a foot. In other embodiments, article of footwear 1400 may not include collar tabs 1490 and 1492.

In some embodiments, article of footwear 1400 includes sole 1401. In this embodiment, sole 1401 may be a wraparound sole. In this embodiment, sole 1401 includes side wall periphery 1410. In some embodiments, side wall periphery 1410 may further include medial extended portion 1412 and lateral extended portion 1414. Generally, portions 1412 and 1414 may be constructed as flaps that extend further beyond side wall periphery 1410. In some embodiments, portions 1412 and 1414 may be attached directly to upper 1404. In other embodiments, portions 1412 and 1414 may not attach directly to upper 1404, but may 'flap' instead with respect to sole 1401.

In addition to sole 1401 and upper 1404, article of footwear 1400 preferably includes toe member 1430. In some embodiments, toe member 1430 may be configured to attach directly to sole 1401. In other embodiments, toe member 1430 may be configured to attach to upper 1404. In a preferred embodiment, toe member 1430 may be configured to attach to both upper 1404 and sole 1401, simultaneously. Generally, toe member 1430 may be made of any durable material including various kinds of rubber. This arrangement preferably provides additional protection to toe region 1432 of article of footwear 1400.

Upper 1404 may be further associated with heel member 1431. In some embodiments, heel member 1431 may be configured to attach directly to sole 1401. In other embodiments, heel member 1431 may be configured to attach to upper 1404. In a preferred embodiment, heel member 1431 may be configured to attach to both upper 1404 and sole 1401, simultaneously. Generally, heel member 1431 may be made of any durable material including various kinds of rubber. In some cases, heel member 1431 may act as a heel counter. This arrangement preferably provides additional protection to heel region 1433 of article of footwear 1400.

Preferably, article of footwear 1400 includes provisions to protect the instep of the foot. During sailing activities, a crewman may find themselves pulling heavy ropes and standing in the vicinity of heavy bars. Therefore, it is important that article of footwear 1400 include provisions for protecting the foot in the event that heavy ropes or bars are dropped onto the foot.

In some embodiments, article of footwear 1400 may be further associated with instep pad 1480. Preferably, instep pad 1480 is associated with instep portion 1482 of upper 1404. In this embodiment, instep pad 1480 may extend from toe member 1430 to just in front of ankle portion 1484. In a preferred embodiment, a front portion of instep pad 1480 is disposed beneath toe member 1430.

Preferably, instep pad 1480 includes provisions to facilitate bending. In the current embodiment instep pad 1480 preferably comprises three major portions, including first padded portion 1451, second padded portion 1452 and third padded portion 1453. Each of these padded portions 1451-1453 preferably extends over the width of instep portion 1482.

In some embodiments, instep pad 1480 may include slots disposed between padded portions 1451-1453. In this embodiment, instep pad 1480 includes first slot 1461 and second slot 1462 that are disposed between first padded portion 1451 and second padded portion 1452. Likewise, instep pad 1480 includes third slot 1463 and fourth slot 1464 that are disposed between second padded portion 1452 and third padded portion 1453.

Preferably, slots 1461 and 1463 are disposed on lateral side 1472 of instep pad 1480. Slots 1462 and 1464 may be disposed on medial side 1474 of instep pad 1480. Furthermore, slots 1461-1464 do not full separate padded portions 1451-1453. With this arrangement, padded portions 1451-1453 remain partially connected.

Figure 16:
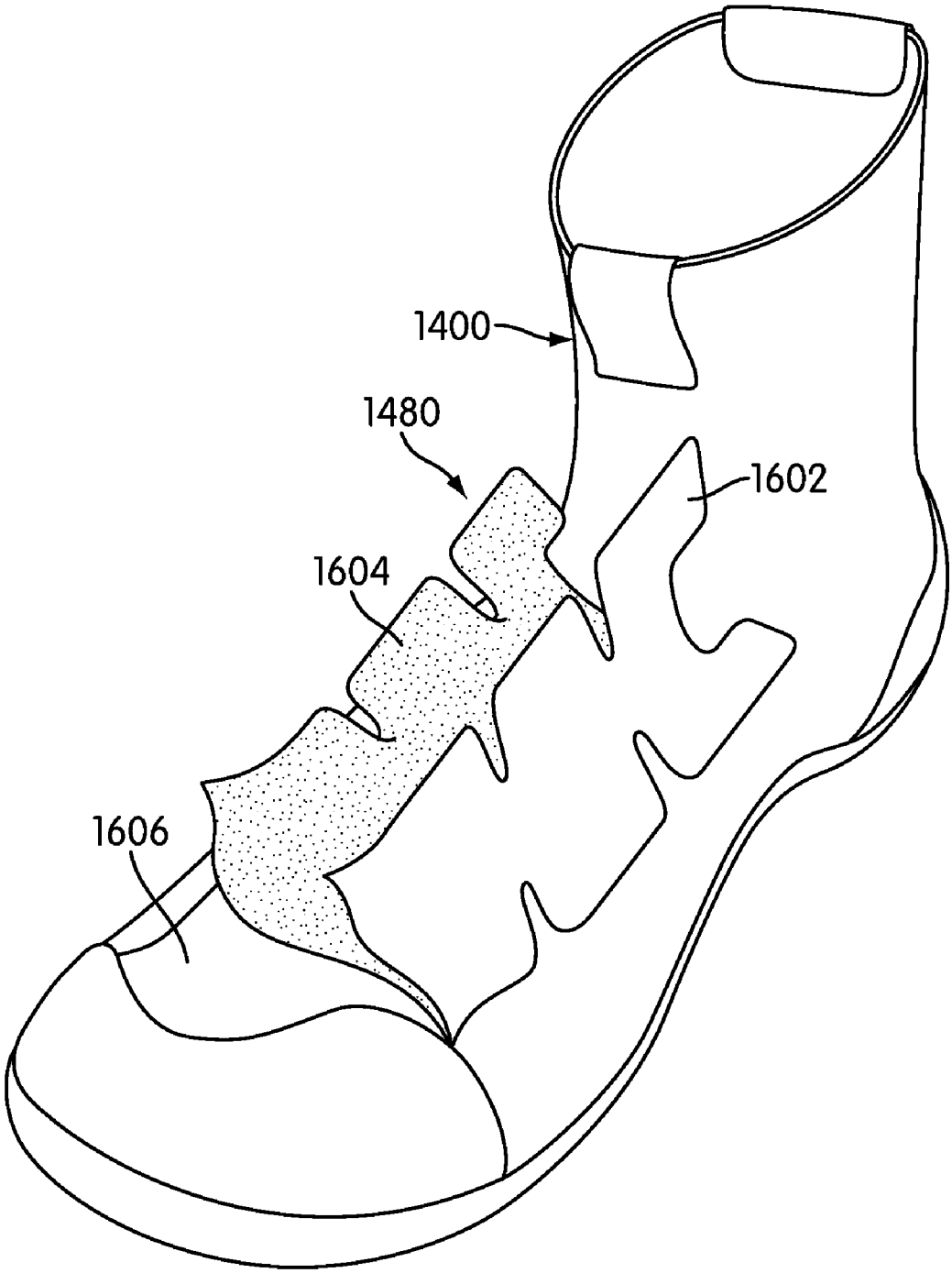
FIG. 16 is an isometric view of a preferred embodiment of an article of footwear.

FIG. 16 is an isometric view of a preferred embodiment of article of footwear 1400. In this embodiment, instep pad 1480 has been opened up to reveal distinct layers. Preferably, instep pad 1480 comprises outer layer 1602 and padding layer 1604. In some cases, instep pad 1480 may also comprise backing layer 1606. It should be understood that backing layer 1606 is an optional layer, and in some cases, outer layer 1602 and padding layer 1604 may be configured to attach directly to upper 1404.

Preferably, padding layer 1604 is made of a shock absorbing material. Examples of such materials include various types of foams. In a preferred embodiment, padding layer 1604 may be made of EVA foam. Additionally, outer layer 1602 may be made of any material, including leather, fabric or other materials commonly associated with footwear uppers. Preferably, outer layer 1602 is configured to protect padding layer 1604 as well as to provide some aesthetic appeal for instep pad 1480. Using this preferred arrangement, instep pad 1480 may be configured to provide protection to the instep portion of the foot.

Figure 17:
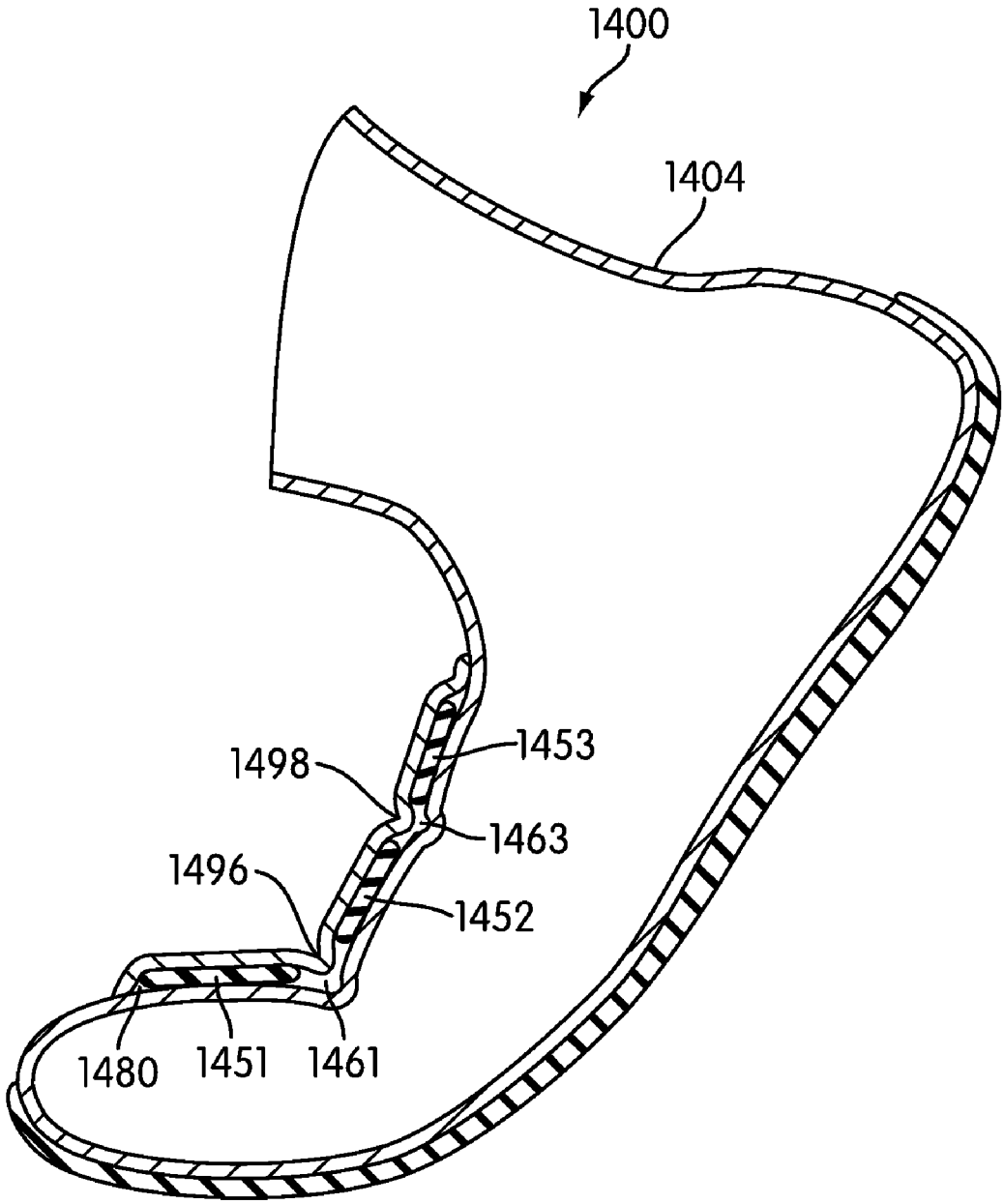
FIG. 17 is a side view of a preferred embodiment of an article of footwear bending.

Referring to FIG. 17, instep pad 1480 preferably provides for some degree of bending of upper 1404. As upper 1404 bends, instep pad 1480 is configured to bend as well. In particular, because of the reduction of width of instep pad 1480 between first slot 1461 and second slot 1462 (see FIGS. 14-15), instep pad 1480 may be configured to bend at first connecting portion 1496. Likewise, because of the reduction of width of instep pad 1480 between third slot 1463 and fourth slot 1464 (see FIGS. 14-15), instep pad 1480 may be configured to bend at second connecting portion 1498.

With this preferred arrangement, padded portions 1451-1453 may be configured to move somewhat independently of one another. This allows for increased flexibility of instep pad 1480. By increasing the flexibility of instep pad 1480, the overall flexibility of upper 1404 may be increased. Preferably, this increased flexibility may help a sailing crewman to more easily move about a sailboat.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What claim:

1. An article of footwear configured to provide traction on a wet surface, comprising:

a water durable upper configured to entirely enclose and conform to a wearer's foot;

a slip-resistant sole;

a first fastening region disposed on the water durable upper adjacent to a periphery of the sole on a lateral side of the footwear;

a first fastening strap including a first fixed portion and a first free portion, wherein the first free portion includes a top side facing outward and a bottom side facing the water durable upper, wherein the bottom side includes a second fastening region at an end of the first free portion and the top side includes a third fastening region at the end of the first free portion, wherein the second fastening region is configured to fasten to the first fastening region, and wherein the first fastening strap configured to extend from a medial side to the lateral side of the footwear;

a second fastening strap including a second fixed portion disposed below the first fastening region on the lateral side of the footwear and a second free portion, wherein the second free portion includes a to side facing outward and a bottom side facing the water durable upper, wherein the bottom side includes a fourth fastening region at an end of the second free portion, and wherein the fourth fastening region is configured to fasten to the third fastening region of the first free portion of the first fastening strap; and wherein the second free portion of the second fastening strap entirely covers the first free portion of the first fastening strap.

2. The article of footwear according to claim 1, wherein the upper includes a plurality of padded members disposed along an instep portion and a front ankle portion of the upper, and wherein the plurality of padded members are oriented such that a longer first dimension side of each of the padded members runs from the lateral side to the medial side of the footwear.

3. The article of footwear according to claim 2, wherein the plurality of padded members are spaced apart from one another.

4. The article of footwear according to claim 3, wherein the padded members are attached to an inner surface of the upper.

5. The article of footwear according to claim 1, wherein the first fixed portion of the first fastening strap is fixed near the sole on the medial side and in a toe region.

6. The article of footwear according to claim 3, wherein the plurality of padded members includes six padded members.

7. An article of footwear configured to provide traction on a wet surface, comprising:

a water durable upper comprising an elastic, flexible material and configured to entirely enclose and conform to a wearer's foot;

a slip-resistant wrap-around sole;

the upper including an inner surface and an outer surface;

a plurality of padding members disposed along an instep portion and a front ankle portion of the footwear;

the plurality of padding members being oriented such that the longer first dimension side of each of the padding members runs from a lateral side to a medial side of the footwear;

the plurality of padding members being spaced from one another along the longer first dimension side such that the intermediate portions, which are unpadded, are disposed between longer first dimension edges;

the plurality of padding members being attached to the inner surface of the upper; and a strap system comprising a first fastening strap and a second fastening strap.

8. The article of footwear according to claim 7, wherein the first fastening strap includes a first fixed portion and a first free portion, wherein the second fastening strap includes a second free portion and a second fixed portion, and wherein the the second free portion of the second fastening strap is configured to entirely cover the first free portion of the first fastening strap.

9. The article of footwear according to claim 8, wherein the first free portion of the first fastening strap is configured to connect to a first fastening region associated with the upper.

10. The article of footwear according to claim 9, wherein the second fixed portion of the second fastening strap is attached to the upper just below the first fastening region.

11. The article of footwear according to claim 10, wherein the second free portion of the second fastening strap is configured to attach to a second fastening region on a top of the first free portion of the first fastening strap.

12. The article of footwear according to claim 7, wherein the plurality of padding members comprises six padding members.

13. The article of footwear according to claim 7, wherein the upper is configured to bend at the instep portion and the front ankle portion.

14. An article of footwear comprising:

a water durable upper comprising an elastic, flexible material and configured to entirely enclose and conform to a wearer's foot;

a slip-resistant wrap-around sole configured to provide traction on a wet surface;

a padded member permanently attached to an inner surface of an instep region of the upper, the padded member being configured to protect an instep portion of a foot, the padded member extending from a toe member to an ankle portion;

the padded member including a first portion and a second portion each extending over a width of the instep region, wherein the first portion and the second portion are centrally connected; and wherein a first slot is disposed between the first portion and the second portion on a lateral side of the footwear and a second slot is disposed between the first portion and the second portion on a medial side of the footwear.

15. The article of footwear according to claim 14, wherein the padded member comprises multiple portions.

16. The article of footwear according to claim 15, wherein the multiple portions are separated by multiple slots.

17. The article of footwear according to claim 14, wherein the first slot and the second slot are v-shaped.

18. The article of footwear according to claim 16, wherein the padded member comprises three portions.

19. The article of footwear according to claim 15, wherein the padded member includes four slots and the multiple portions are centrally connected.

20. The article of footwear according to claim 14, wherein the padded member includes an outer layer and a padding layer.

* * * * *